US007546789B2

(12) United States Patent
Reddell et al.

(10) Patent No.: US 7,546,789 B2
(45) Date of Patent: Jun. 16, 2009

(54) WHOLE MUSCLE SLICER AND SEPARATOR

(75) Inventors: Tim Reddell, Bentonville, AR (US); Charley Reed, Tontitown, AR (US); Marshall Vanderpool, Bentonville, AR (US); Kelvin D. Lasse, Springdale, AR (US); James Ruff, Farmington, AR (US)

(73) Assignee: Tyson Foods, Inc., Springdale, AR (US)

( * ) Notice: Subject to any disclaimer, the term of this patent is extended or adjusted under 35 U.S.C. 154(b) by 312 days.

(21) Appl. No.: 11/463,001

(22) Filed: Aug. 7, 2006

(65) Prior Publication Data

US 2008/0028906 A1 Feb. 7, 2008

(51) Int. Cl.
*B26D 7/32* (2006.01)

(52) U.S. Cl. ..... 83/122; 83/102; 83/105; 83/500

(58) Field of Classification Search ..... 83/84, 83/88, 89, 122, 120, 105, 102, 107
See application file for complete search history.

(56) References Cited

U.S. PATENT DOCUMENTS

| | | | | | |
|---|---|---|---|---|---|
| 1,481,417 | A | * | 1/1924 | Cove | 83/122 |
| 1,673,336 | A | * | 6/1928 | Lehmicke | 83/122 |
| 1,866,941 | A | * | 7/1932 | Peters | 83/89 |
| 2,094,987 | A | * | 10/1937 | Klahre | 83/105 |
| 2,258,428 | A | * | 10/1941 | Stalder | 225/2 |
| 2,598,550 | A | * | 5/1952 | Jackson | 452/142 |
| 2,912,027 | A | * | 11/1959 | Townsend | 452/127 |
| 3,148,720 | A | * | 9/1964 | Olson et al. | 83/122 |
| 3,324,915 | A | | 6/1967 | Townsend | |
| 3,516,315 | A | * | 6/1970 | Suzuki | 83/408 |
| 3,762,254 | A | * | 10/1973 | Tsymbal et al. | 83/107 |
| 3,844,207 | A | | 10/1974 | Townsend | |
| 4,116,098 | A | * | 9/1978 | Suzuki et al. | 83/425.4 |
| 4,408,519 | A | | 10/1983 | Schill | |
| 4,638,934 | A | * | 1/1987 | Fram | 225/97 |
| 4,919,027 | A | * | 4/1990 | Littleton | 83/107 |
| 5,011,454 | A | | 4/1991 | Townsend | |
| 5,129,299 | A | * | 7/1992 | Fischer et al. | 83/356.3 |
| 5,196,020 | A | | 3/1993 | Atkinson et al. | |
| 5,236,323 | A | | 8/1993 | Long et al. | |

(Continued)

OTHER PUBLICATIONS

"HMPT". Ranken, M.D. Handbook of Meat Product Technology. Blackwell Publishing. © 2000 Online version available at: http://knovel.com/web/portal/browse/display?_EXT_KNOVEL_DISPLAY_bookid=1894&1894&VerticalID=0.*

*Primary Examiner*—Kenneth E. Peterson
*Assistant Examiner*—Sean Michalski
(74) *Attorney, Agent, or Firm*—Mark E. Stallion, Esq.; Husch Blackwell Sanders LLP

(57) ABSTRACT

A whole muscle slicer and separator that solves the product separation problem and other problems found with an ordinary slicer. The invention is where one embodiment includes a special peel out finger bar comb that peels out every other product piece onto a conveyor and a final comb that peels out the remaining product pieces onto a second conveyor. This can be accomplished by tilting the cutting assembly to about approximately a 45 degree angle off vertical. There can be an upper and lower combs arranged in a interfacing relationship with the cutter for separating the product. Another embodiment includes a single finger bar comb having two sets of fingers.

14 Claims, 17 Drawing Sheets

U.S. PATENT DOCUMENTS 5,350,334 A * 9/1994 Holms ..... 452/127
5,482,166 A * 1/1996 Brown ..... 209/580
5,558,573 A 9/1996 Basile, II. et al.
5,609,519 A 3/1997 Townsend
5,704,265 A * 1/1998 Johnson et al. ..... 83/77
6,129,625 A 10/2000 Cate et al.
6,357,346 B1 3/2002 Townsend
6,640,681 B1 11/2003 Weber
6,659,856 B2 12/2003 Long
6,763,748 B2 * 7/2004 Wolcott et al. ..... 83/29
6,824,460 B2 11/2004 Young et al.
6,834,576 B2 12/2004 Leitinger

* cited by examiner

WHOLE MUSCLE SLICER AND SEPARATOR

BACKGROUND OF INVENTION

1. Field of Invention

This invention relates generally to a method and apparatus for slicing a meat product and, more particularly, to slicing a whole muscle meat product and separating the slices.

2. Background Art

There are various apparatus and methods for slicing whole muscle meat products into multiple slices utilizing a cutting blade or multiple cutting blades. A typical process is to flatten a whole muscle product sufficiently to be feed through a cutter that is operable to slice the flattened whole muscle product into thin strips for further processing. However, once the muscle product is sliced into multiple strips by a typical slicer, the strips are not readily separated. It is not uncommon for the slices to be separated manually or by some other means once the meat product has exited the slicer assembly.

For example a Key Isoflow™ shaker table has been utilized to separate sliced product once it has exited a slicer and pre-dust machine. However these types of slicer systems are not able to separate the flattened whole muscle product as it travels through the slicer assembly. Separation of the product after it has exited the slicer assembly slows down the over all process of manufacturing the final product because the sliced product must be separated prior to or after subsequent processing, such as for example a breading process. A better apparatus and method is needed for slicing and separating the product.

BRIEF SUMMARY OF INVENTION

The invention is a whole muscle slicer and separator that solves the product separation problem and other problems found with an ordinary slicer. The invention includes a cutter assembly having a special peel out upper finger bar comb having teeth or fingers that peels out every other product piece onto a conveyor and a lower finger bar comb that peels out the remaining product pieces onto a second conveyor. The upper and lower designation is only one embodiment and is not intended to limit the scope of the invention nor intended to describe a particular positional relationship between the two finger bars. Other arrangements are possible without departing from the scope of the invention.

For example, a single finger bar comb having two sets of teeth or fingers can be an alternative embodiment. This process can be accomplished by either embodiments by tilting the muscle slicer cutter and separator assembly to about approximately a 45 degree angle off vertical. Most other slicer cutter assemblies are at a 90 or 180 degree configuration. The about approximately 45 degree angle off vertical can vary without departing from the scope of the invention. The raw whole muscle product can be chilled so that the product is semi-rigid in order for the product to be sliced and separated correctly. There can be an upper and lower comb arranged in an interfacing relationship with the cutter, where the cutter is a cutter roll having multiple radially projecting coaxial circular cutting blades forming a cutting vane along the length of the roller where the circular blades are proximately spaced apart along the cutter roll's length.

The process for slicing and separating can include the steps of Chilling and/or Crusting the raw whole muscle product by using a tumble chiller or nitrogen dip. The product can then be run through a flattener machine to achieve proper product thickness, which can be about approximately ⅜". This can vary significantly depending on the desired thickness of the product and the configuration of the slicer cutter assembly. The product can then be transferred onto the slicer in-feed conveyor, which feeds product into blades at an optimal angle. The product can be driven through the blades and shear roller by a textured pusher roller.

As the product is being sliced, a special comb can be designed to divert every other slice of product onto a first takeaway belt. The product slices can be separated from each other by the distance between the circular blades, such as for example about approximately ⅜". The distance between the blades can vary significantly depending on the desired thickness and the space between the blades. The remaining product slices can be diverted onto a second takeaway belt by the final clean out comb. Again the product slices can be separated from each other by the distance between the blades.

Another embodiment of the invention is a single comb configuration where the single comb has a first set and a second set of fingers. The first set can be angled to divert one group of slices and the second set to divert the remaining group of slices.

The thickness of the flattened product and the width of the slices can vary significantly without departing from the scope of the present invention.

The two takeaway conveyors can feed onto an S-merge conveyor that transfers the slices onto a subsequent takeaway conveyor. The slices can now be further processed (Frozen, Breaded, etc.). The slicer/separator is different from others in that it will provide spacing between products while exiting the slicer blades onto two different conveyors. This keeps the product from touching each other and allows for flat bed breading, freezing, etc.

These and other advantageous features of the present invention will be in part apparent and in part pointed out herein below.

BRIEF DESCRIPTION OF THE DRAWINGS

For a better understanding of the present invention, reference may be made to the accompanying drawings in which.

DETAILED DESCRIPTION OF INVENTION

Figure 1:
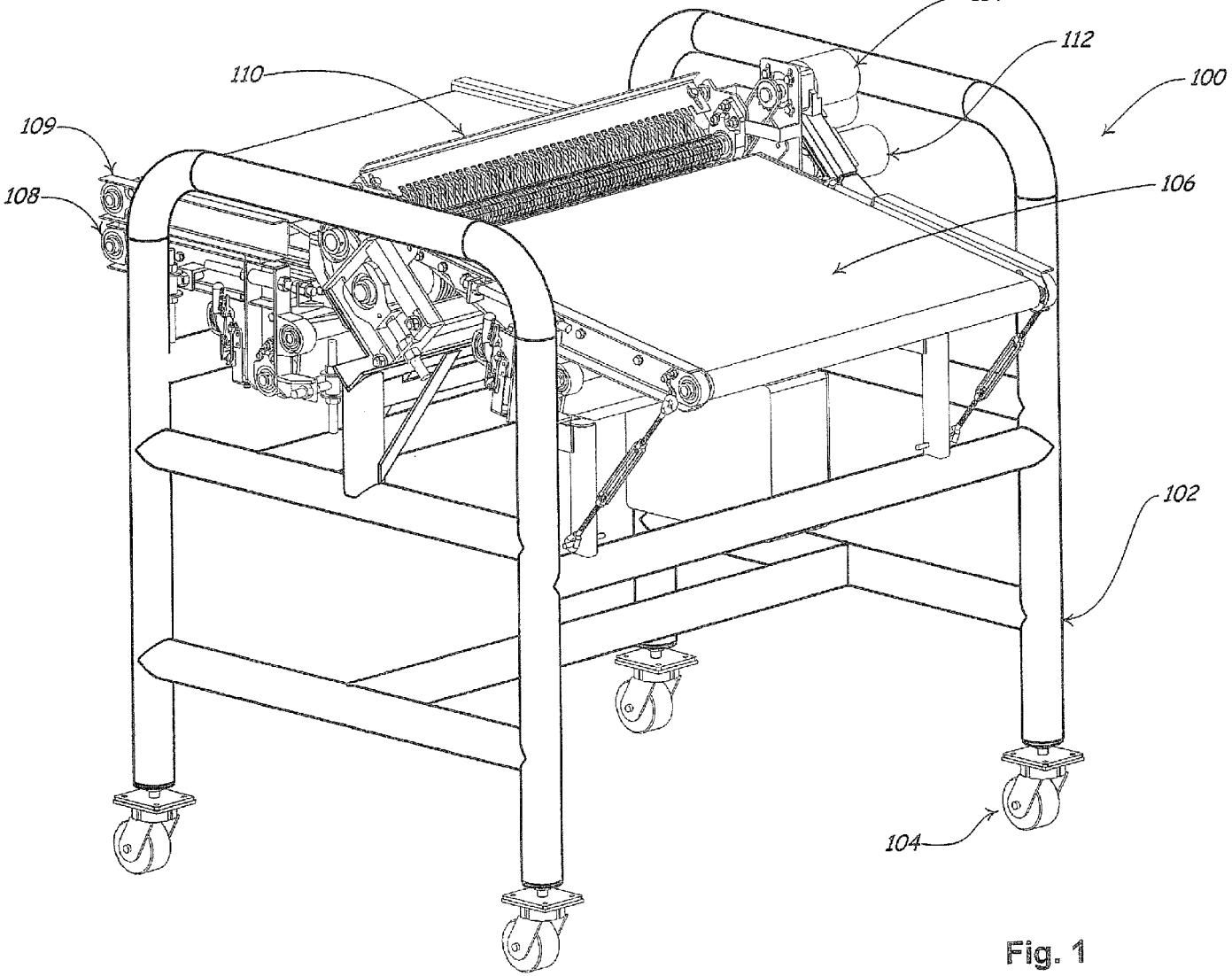
FIG. 1 is a perspective view of a whole muscle slicer and separator assembly.

According to the embodiment(s) of the present invention, various views are illustrated in FIGS. 1-17 and like reference numerals are being used consistently throughout to refer to like and corresponding parts of the invention for all of the various views and figures of the drawing. Also, please note that the first digit(s) of the reference number for a given item or part of the invention should correspond to the Fig. number in which the item or part is first identified.

One embodiment of the present invention comprising a cutter assembly having two combs teaches a novel apparatus and method for separating product strips as the strips are exiting the slicer cutter assembly and separator.

Another embodiment of the present invention comprises a single comb where the comb has two stages or two sets of teeth or fingers in order to work similar to the two comb configuration.

The details of the invention and various embodiments can be better understood by referring to the figures of the drawing. Referring to FIG. 1, a perspective view of the muscle slicer and separator assembly is shown. The muscle slicer and separator assembly 100 is shown having a main frame 102 that supports the overall assembly. In this embodiment, the main frame is shown constructed of a tubular metal stock. The overall frame can be supported on four caster wheels 104 for mobility. The material construction and configuration of the frame can vary without departing from the scope of the present invention.

Figure 1A:
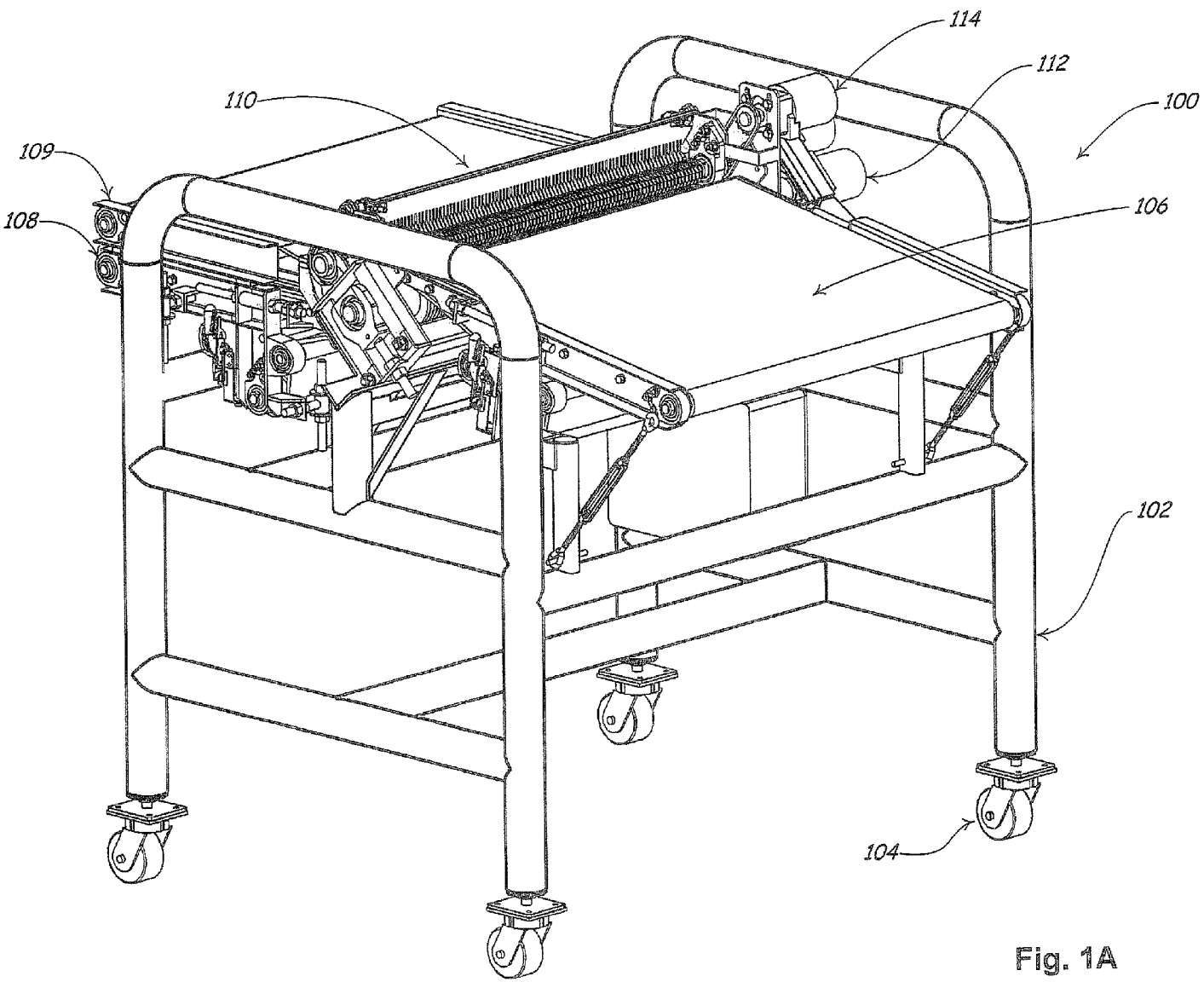
FIG. 1A is a perspective view of a whole muscle slicer with single finger bar.

The main frame can support a cutter assembly 110 which receives and slices the product. The cutter assembly is shown positioned between three conveyors. One conveyor is an in-feed conveyor 106 and the other conveyors are takeaway conveyors 108 and 109. The cutter assembly 110 is shown mounted between the conveyors for receiving the meat product along a line of entry 201, See FIG. 2, from the in-feed conveyor and then discharging the product onto the takeaway conveyors. Prior to being received by the muscle slicer and separator assembly 100, the product can be adequately flattened and then conveyed into the slicer and cutter assembly by the in-feed conveyor. The cutter assembly can be mounted at an angle or such that the center line 203 is between horizontal and vertical and in the embodiment as shown, at about approximately a 45 degree angle with respect to vertical. See item 202 in FIG. 2. The angular positioning of the cutter assembly optimizes the ability to separate the product slices for diverting onto takeaway conveyors. FIG. 1 also shows the pinch roller motor 112 and the push roller motor 114. FIG. 1 illustrates the two finger bar comb embodiment. However, FIG. 1A illustrates the single bar embodiment.

Figure 2:
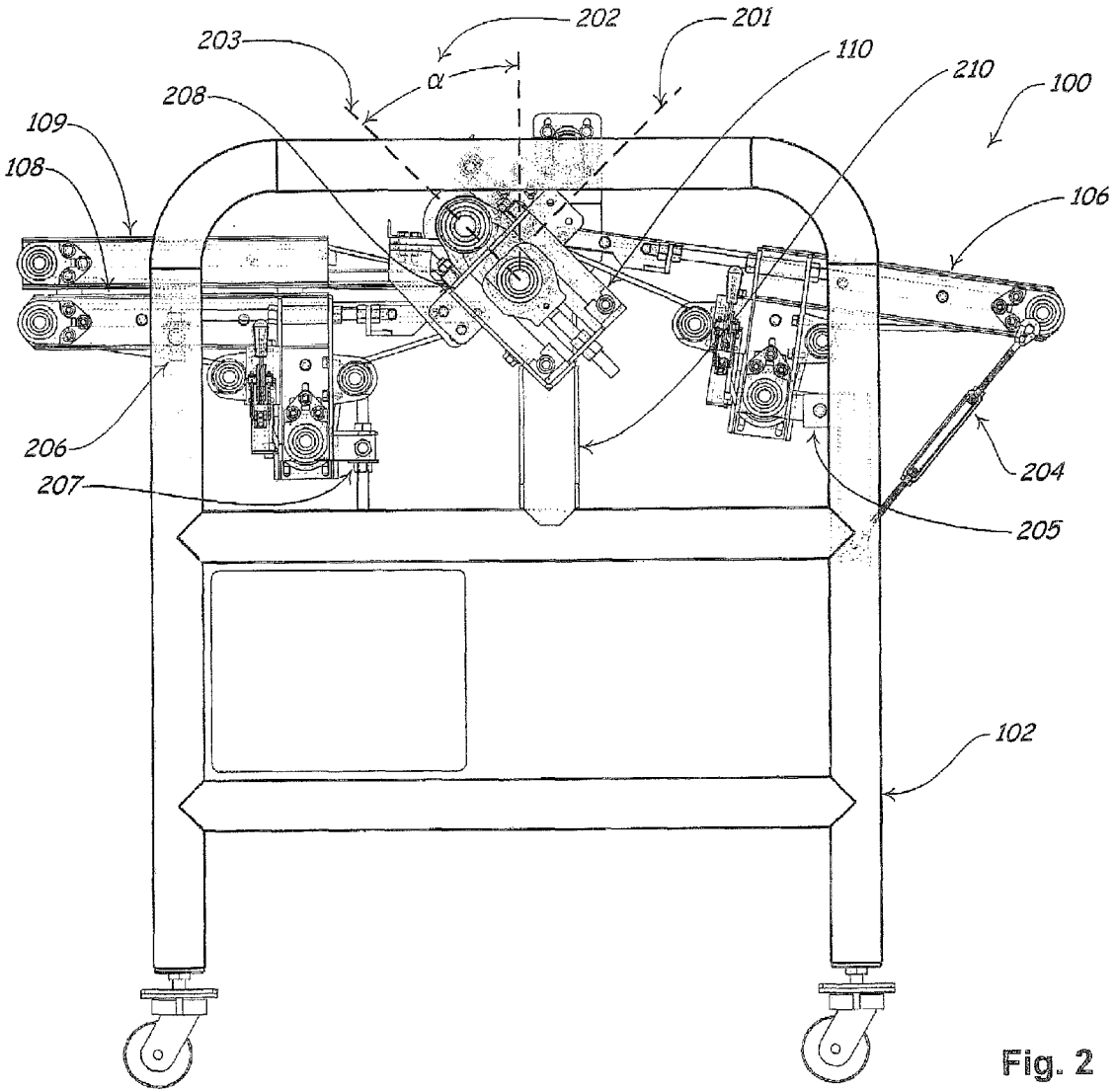
FIG. 2 is a side view of the whole muscle slicer and separator assembly.
Figure 2A:
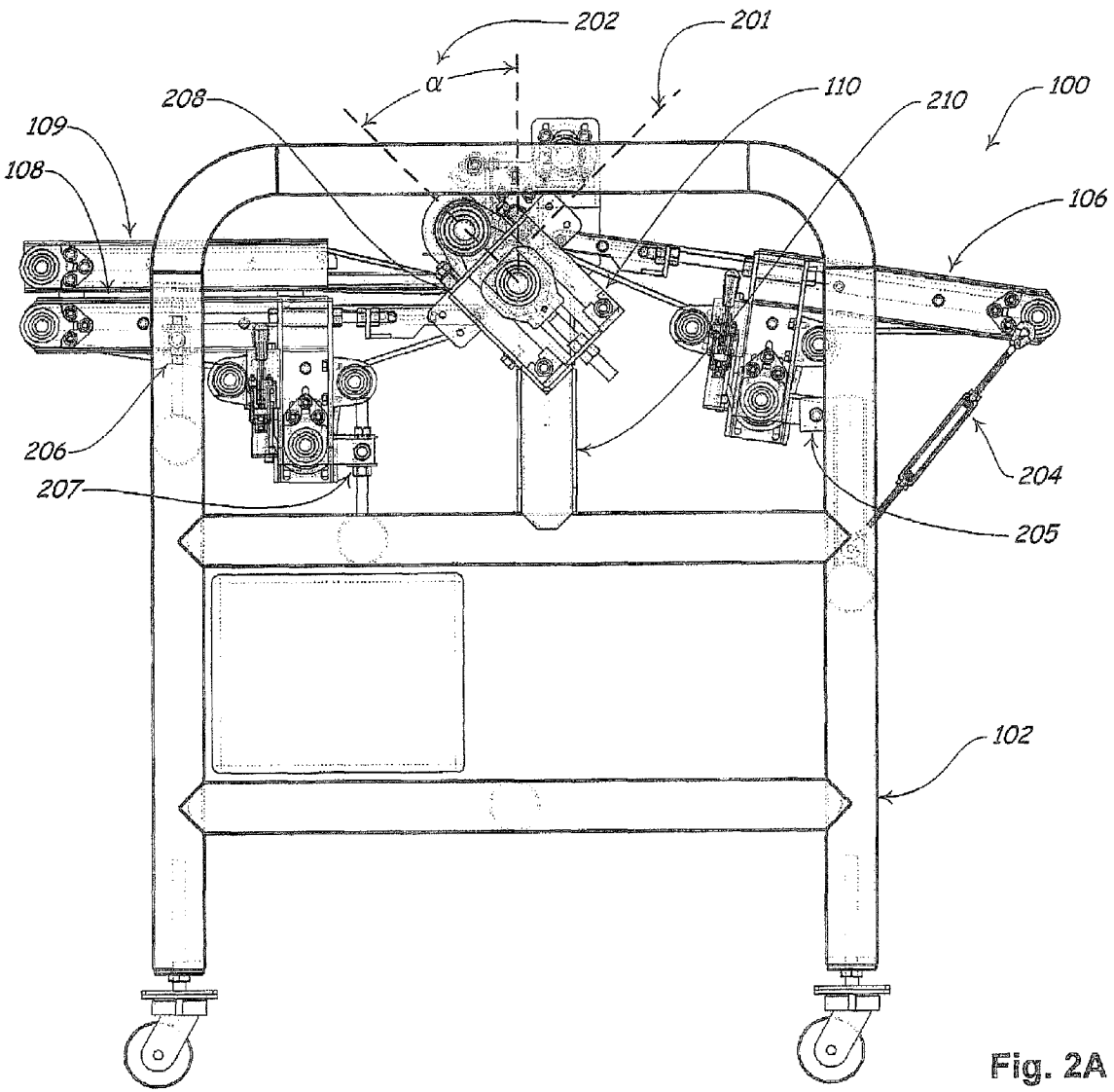
FIG. 2A is a side view of the whole muscle slicer with single finger bar.

Referring to FIG. 2, a side view of the main frame is shown revealing one embodiment of the relative mount positions for the in-feed conveyor 106 and the takeaway conveyors 108 and 109. From the side view of this embodiment, the about approximately 45 degree angular positioning of the cutter assembly can be clearly seen. This angle can obviously vary without departing from the scope of the invention. The angle can vary between horizontal and vertical to optimize the line of entry and to optimize the position such that the exiting product can be fed onto the takeaway conveyors. For example, the angle can be about approximately 45 plus or minus 20 degrees off vertical. A typical cutter assembly utilized for slicing product is typically arranged in a vertical or horizontal position, however, the angular positioning of the cutter assembly in the present invention facilitates separation of the sliced product and diverting the product to the takeaway conveyors. The angular (off-vertical orientation) of the cutter assembly as reflected by angle alpha and identified by item number 202 can vary without departing from the scope of the present invention. The angle 202 can be about approximately 45 degrees but can vary about approximately plus or minus 20 degrees. The line of entry 201, and can also be at an angle between horizontal and vertical.

The cutter assembly 110 is positioned between the in-feed conveyor 106 and the takeaway conveyors 108 and 109. The takeaway conveyors 108 and 109 can be adjustably mounted to the frame by the adjustable conveyor mounts 207 and 206. The in-feed conveyor pivot mount 205 and the adjustable support member 204 allows the in-feed conveyor to be pivoted to adjust its slope such that the in-feed conveyor is positioned and has the optimal slope to properly feed the whole muscle product into the cutter assembly along the line of entry. Adjustable mount 206 and 207 allows the takeaway conveyors 108 and 109 to be raised or lowered for appropriate positioning to receive the sliced product for conveying away from the cutter assembly 110. The cutter assembly can also be raised or lowered on the cutter support assembly 210. The assembly 110 has a support frame 208 for the pinch roller and the cutter. All conveyors can also be adjusted longitudinally along the same axis that the product travels to facilitate loading and unloading.

These various adjustments of the conveyors and the cutter assembly allow for optimizing the in-feed of the product into the cutter assembly 110 and the taking away of the sliced product. The slope or angular rise or incline above horizontal in the direction of conveyance of the in-feed conveyor can vary to optimize feeding the product into assembly 110. The height of conveyors 108 and 109 can vary to optimize diverting the sliced product onto the conveyors 108 and 109. The height adjustment along cutter support assembly 210 of the cutter assembly 110 can also optimize in-feed and take-away. The in-feed conveyor can also have a conveyor belt having a surface having space apart raised ribs for feeding into the cutter.

Figure 3:
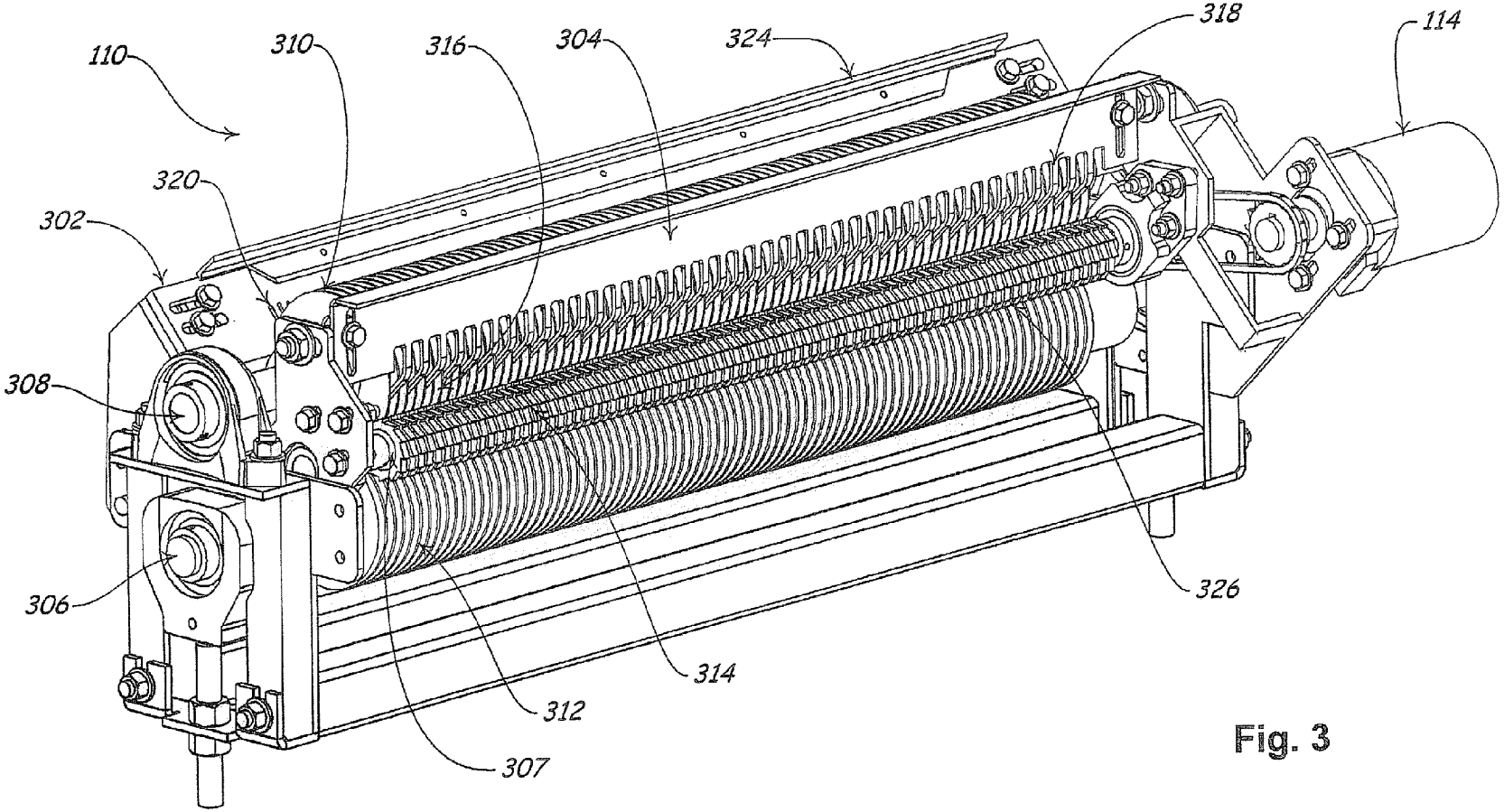
FIG. 3 is a perspective view of the cutter assembly.

Referring to FIG. 3, a perspective view of the cutter assembly 110 is shown. The assembly 110 includes a rotatable pinch roller 306 and a rotatable push roller 307 for receiving the product from the in-feed conveyor. The in-feed conveyor feeds the product into the interface 326 between the pinch roller 306 and the push roller 307. The pinch roller 306 can have a ribbed roll surface 312 comprising radially extending circular ribs for grasping the product. The push roller 307 can have a textured roll surface 314 having teeth for further grasping the product and pushing the product through the cutter assembly 110.

The cutter 308 or rotatable cutting roller has a plurality of circular spaced apart blades 310 for slicing the product into thin slices as it is fed though the cutter assembly. The circular blades 310 are spaced apart along the length of the cutting roller forming a cutting vane. The space 316 between adjacent blades defines the width of the product slices. The circular blades extend radially outward from the cutter roll. Multiple circular blades create a cutting vane or cutting fins along the length of the cutting roll. This creates spaces between the circular blades along the cutting vane. The pinch roller can also have radially extending circular ribs along its length that can extend into the spaces between the circular blades.

Figure 3A:
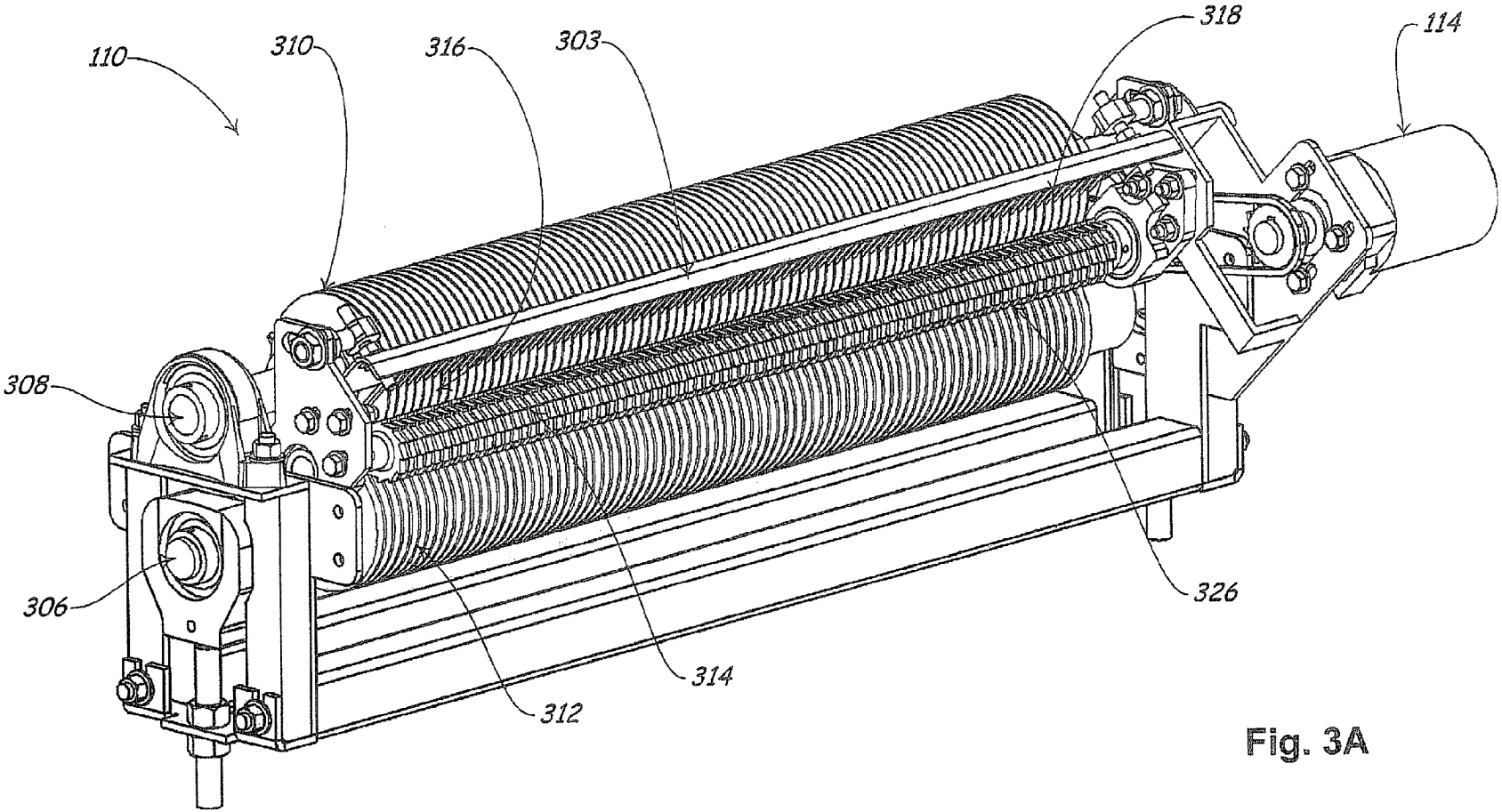
FIG. 3A is a perspective view with single finger bar.

The cutter assembly can further include an upper finger bar comb 302 which is mounted on one side of the cutter 308. The upper finger bar comb has a plurality of teeth or fingers 320. The upper finger bar comb can be positioned such that the fingers extend into the space between the circular cutter blades 310 for diverting the sliced product onto a takeaway conveyor. The lower finger bar comb 304 also has a plurality of fingers 318 or teeth that extend into the spaces 316 between the plurality of circular blades that are spaced along the length of the cutting roller. The upper finger bar fingers can be configured such that the fingers extend into every other space between the circular blades of the cutter and the lower finger bar fingers can be configured such that the fingers extend into the alternate spaces between the blades. FIG. 3A shows the single finger bar 303 embodiment where two sets of fingers or teeth extend into the spaces 316 between the cutter blades 310.

Figure 4:
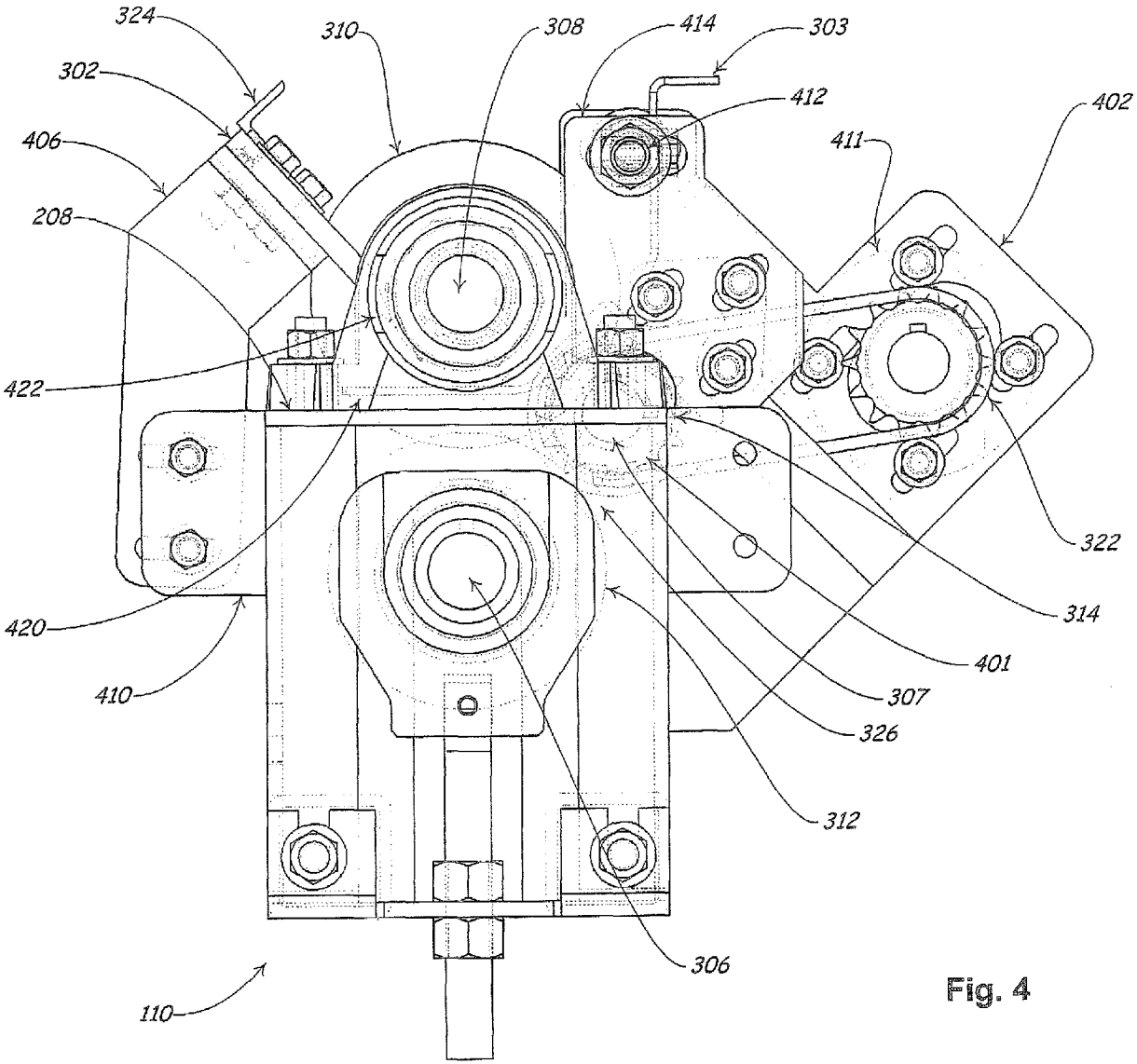
FIG. 4 is a side view of the cutter assembly.

Referring to FIG. 4, a side view of the cutter assembly is shown. Again, the pinch roller 306 and the push roller 307 (shown as shadow lines) is shown. The side view reveals the support frame 208 for the pinch roller having a bearing for supporting the axial extension of the pinch roller. The side view of the push roller 307 reveals a textured surface 314 of the roller which has protruding teeth members 401 (shown as shadow lines) for grasping and pushing the product through the cutting blades. The side view also reveals the relevant positions between the pinch roller, the push roller and the cutter. The teeth of the push roller can extend into the spaces between the circular blades of the cutter. The engagement interface 326 between the push roller and the pinch roller can be clearly seen. It is in this area that the product is grasped and fed into the cutter 308.

The side view further reveals the circular shape of the cutter blades 310. This side view also reveals the mounting arrangement of the upper and lower finger bars 302 and 304 respectively. Slotted adjustable mount 412 allows the lower finger bar comb 304 to be mounted closer to or further from the cutter 308. The upper finger bar 302 is mounted onto mounting bracket 406 and secured by a stiffening plate 324. The lower finger bar 304 is mounted on mounting bracket 414. Mount 412 allows the lower finger bar comb 304 to be mounted closer to or further from the cutter 308. The shadow lines showing the cross sections of the two finger bars show how the fingers of the finger bar combs extend between the circular blades of the cutter. The support frame 208 for the cutter and pinch roller is also shown. The reason for having two sets of combs (or alternatively one comb with two sets of fingers having alternating bends—see FIGS. 1A, 2A, 3A, 4A, 4B and FIGS. 14-17) is to have two sets of clean-out fingers and two "exist points" from the cutting blades—thus separating every other product slice by diverting one set to the bottom takeaway conveyor below and the alternating set to the upper takeaway conveyor above.

FIGS. 1A, 2A, 3A, 4A and 4B show a single finger bar comb embodiment where the adjacent teeth or fingers alternate from bent to straight thereby forming two sets of fingers or teeth where each set addresses the cutter at different points which cleans-out and separates the slices diverting every other slice to the bottom take away conveyor and the remaining slices to the upper conveyor. The same is accomplished by the two finger bar embodiment where one has straight finger and the other has bent fingers and the two bars address the cutter at two different locations.

The fingers of the upper finger bar comb can be operable to divert a first set of sliced product onto a first take-away conveyor and the lower finger bar comb can be operable to divert a second set of sliced product onto a second take-away conveyor. The fingers of the upper finger bar and the fingers of the lower finger bar can be configured to extend into alternate spaces between the cutting blades. The embodiment as shown has stacked take away conveyors, which can best be seen in FIG. 4B.

Figure 5A:
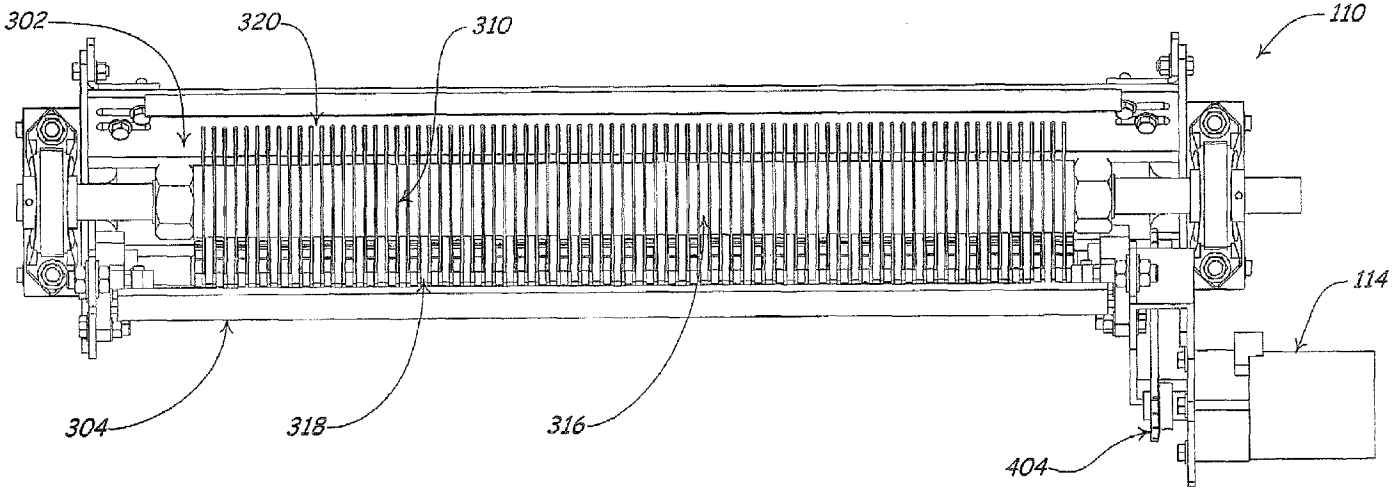
FIG. 5A is a top view of the cutter assembly.

Referring to FIG. 5A, a top plan view of the cutter assembly is shown. The lateral positioning of the lower and upper finger bar combs are shown. Further, the fingers 318 of the lower finger bar comb is shown extending into the spaces 316 between the cutting blades 310. Also, the fingers 320 of the upper finger bar comb are shown extending into the alternate spaces 316 between the cutting blades. The finger spacing in a comb can be such that every other space between the cutter blades has a finger from that comb extended therein to address the cutter for cleaning out the product slices diverting them onto the takeaway conveyors. The remaining alternating spaces between the cutter blades can have the fingers from another finger bar extended therein.

Figure 5B:
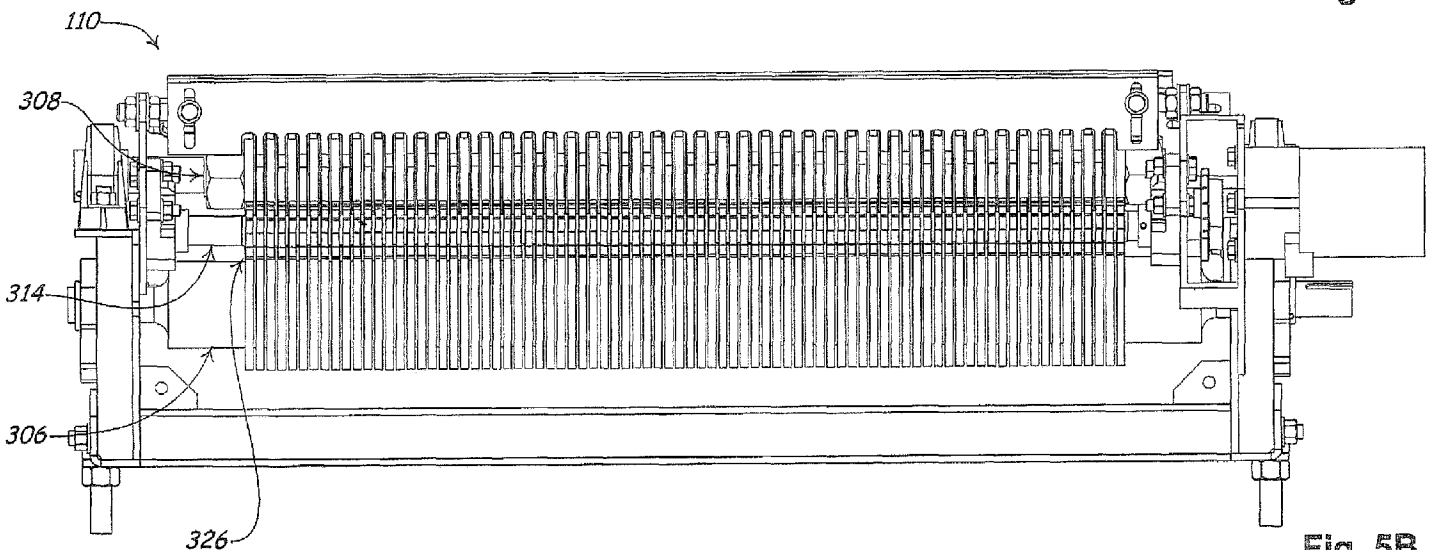
FIG. 5B is a front plan view of the cutter assembly.
Figure 5C:
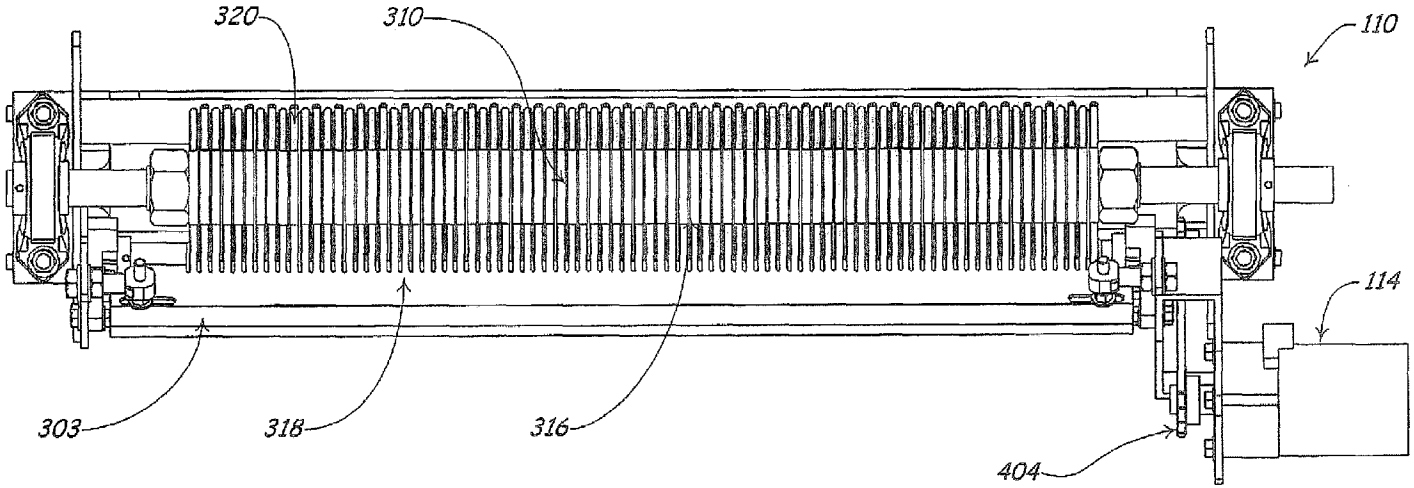
FIG. 5C is a top view of the single finger bar embodiment.
Figure 5D:
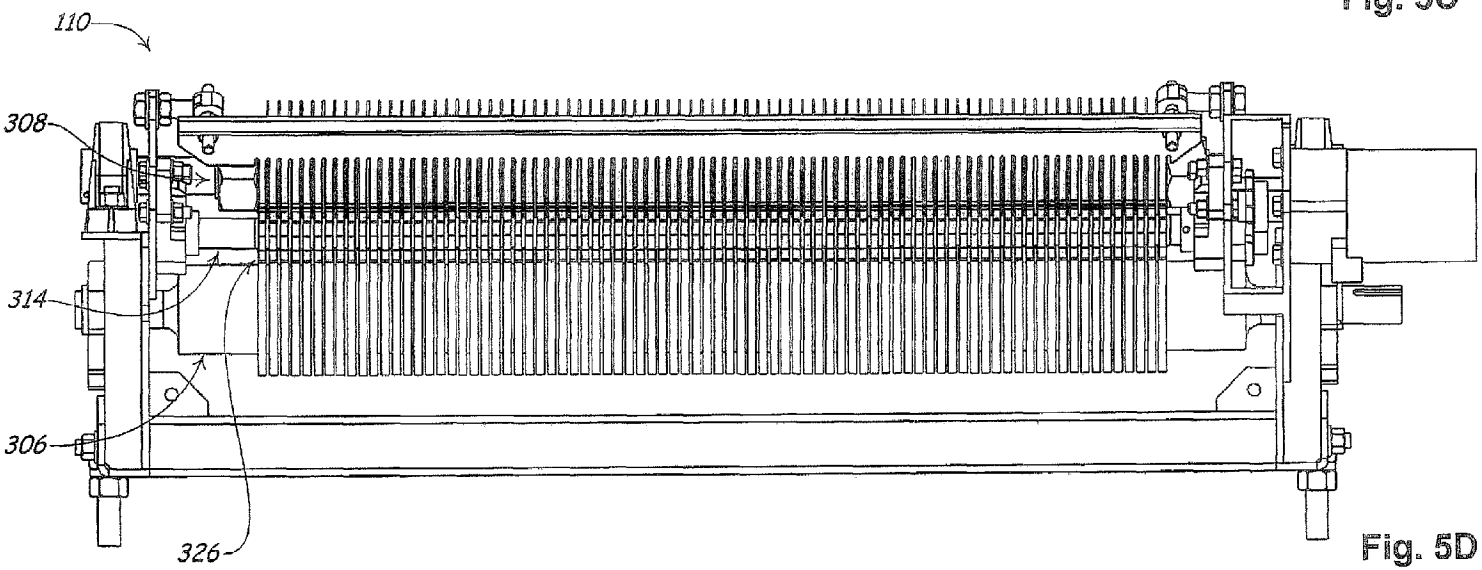
FIG. 5D is a front view of the single finger bar embodiment.

Referring to FIG. 5B the relative vertical positions of the pinch roller 306, the push roller 307 and the cutter 308 or cutting roller is shown. The cylindrical axis of the pinch roller and the cylindrical axis of the cutting roller can be parallel and can lie within a common plane. The relative positions of the pinch roller and the cutting roller can also be seen. The plane in which these two cylindrical axis lie can be angled between horizontal and vertical, such that the line of entry 201 is between horizontal and vertical. This view reveals the area 326 between the pinch roller and the push roller. FIGS. 5C and 5D reflect the single finger bar comb embodiment.

Figure 6:
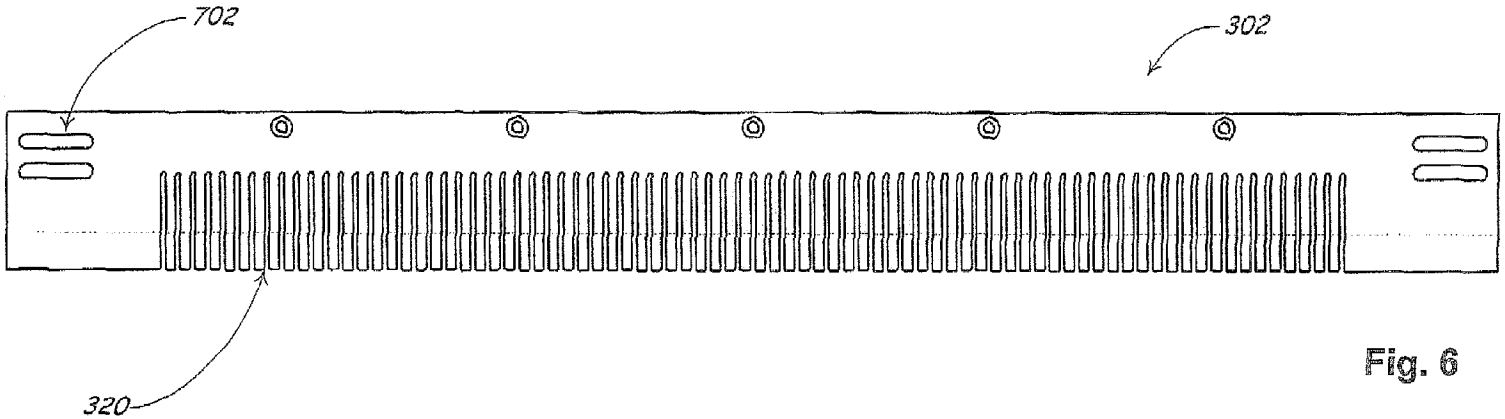
FIG. 6 is a top plan view of the upper finger bar.
Figure 7:
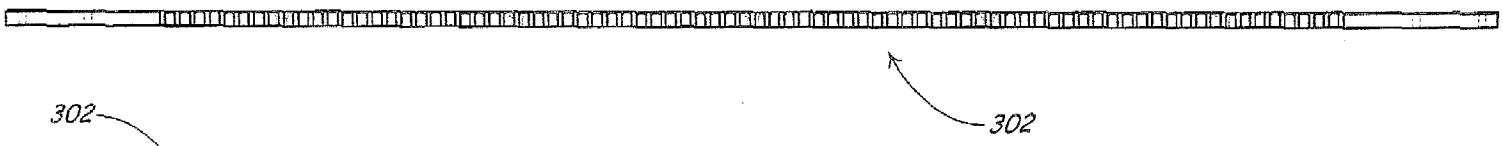
FIG. 7 is a front view of the upper finger bar.
Figure 8:
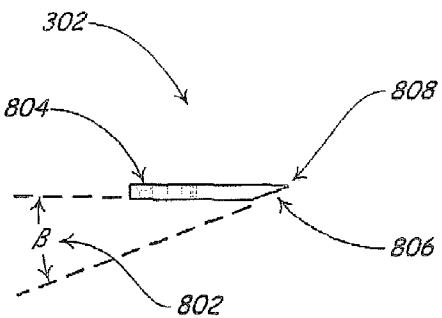
FIG. 8 is a side view of the upper finger bar.
Figure 9:
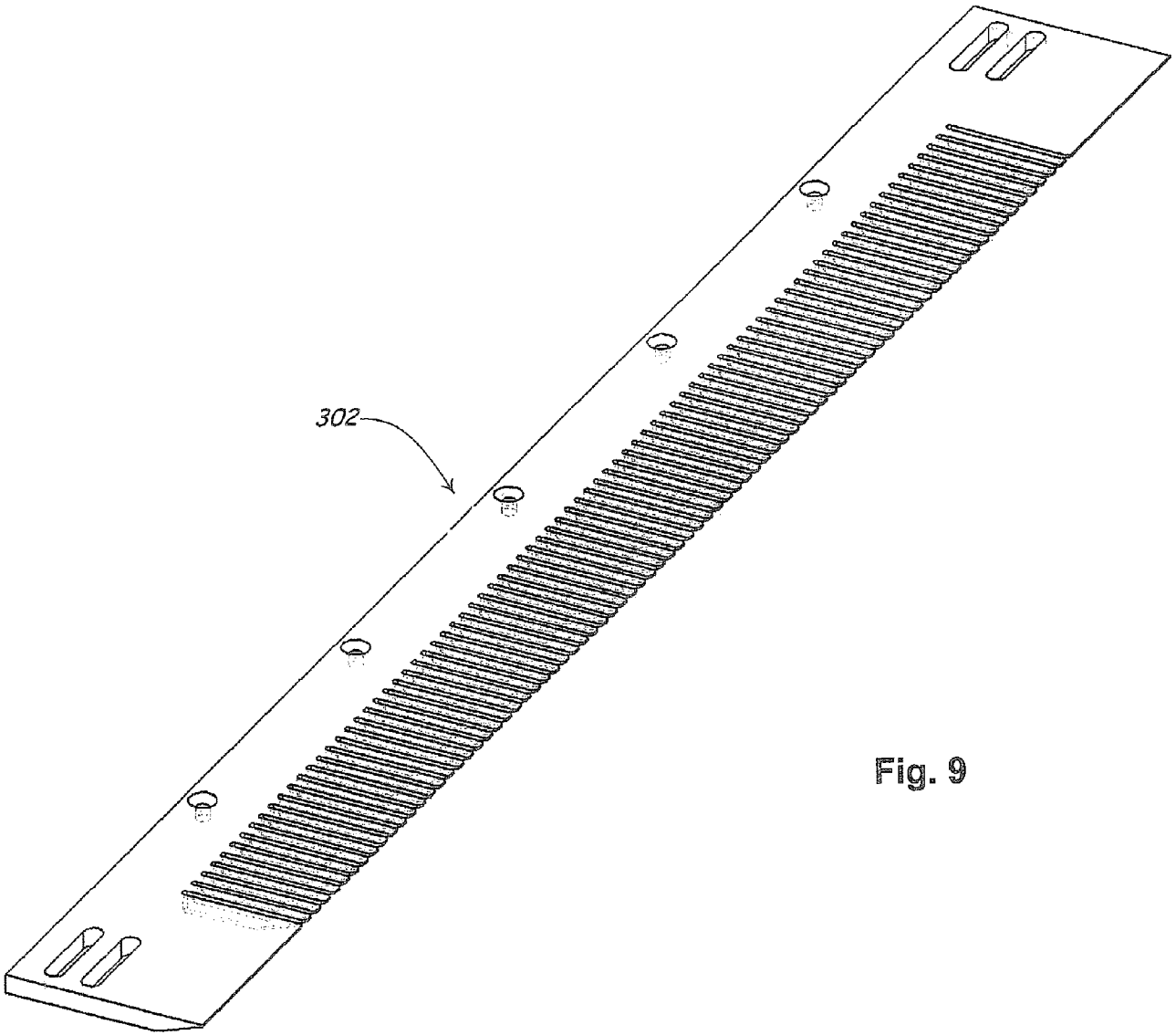
FIG. 9 is a perspective view of the upper finger bar.

Referring to FIGS. 6 and 7, a top plan view and a front plan view of the upper finger bar comb is shown. The comb is shown with slotted cutouts 702 for adjustably mounting the finger bar comb onto the cutter assembly. The cutouts 702 are elongated to allow for length wise adjustment of the finger bar relative to the cutter determining how far the fingers extend into the spaces between the circular blades. This figure also reveals the plurality of fingers 320 which can extend between the circular blades of the cutter. FIG. 8 shows a side view of the upper finger bar comb. The side view reveals a beveled end 806 which extends to a point 808. The angle beta as identified by 802 reflects the angle of the bevel. The angle 802 of the bevel can vary to optimize the diverting of the product slices. FIG. 9 shows a perspective view of the upper finger bar comb 302. The mounting position of the upper finger bar as shown in FIG. 4 is such that the sliced product can be diverted onto the upper conveyor 109 and the mounting position of the lower finger bar is such that product is diverted to the lower conveyor.

Figure 10:
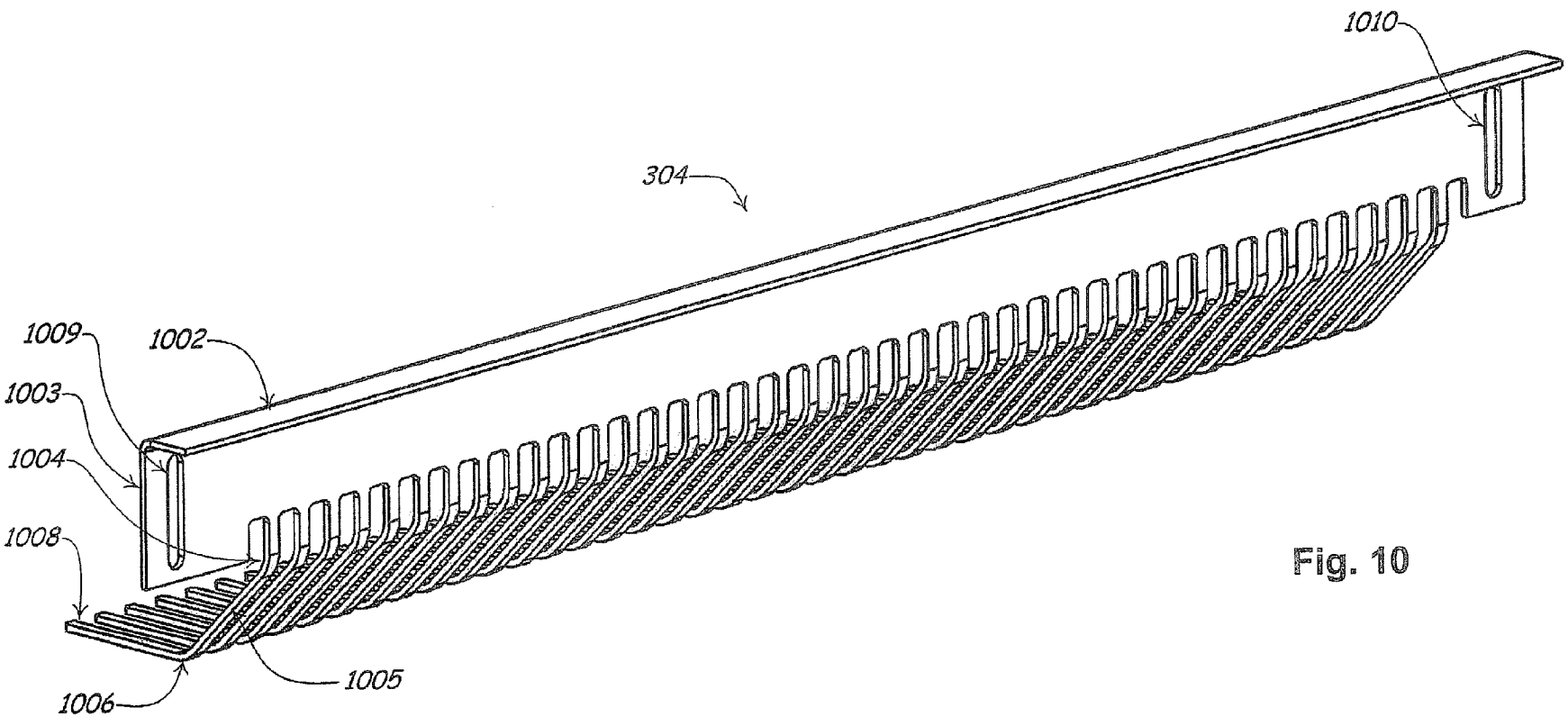
FIG. 10 is a perspective view of the lower finger bar.
Figure 11:
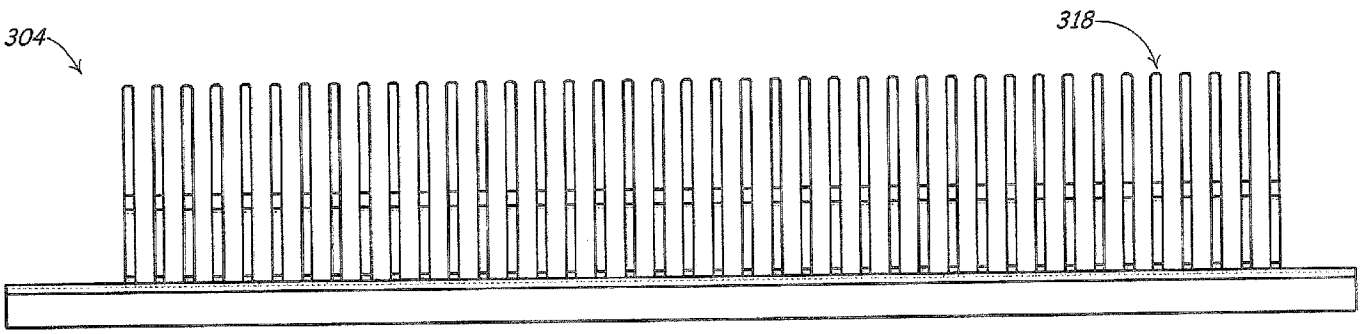
FIG. 11 is a top plan view of the lower finger bar.
Figure 12:
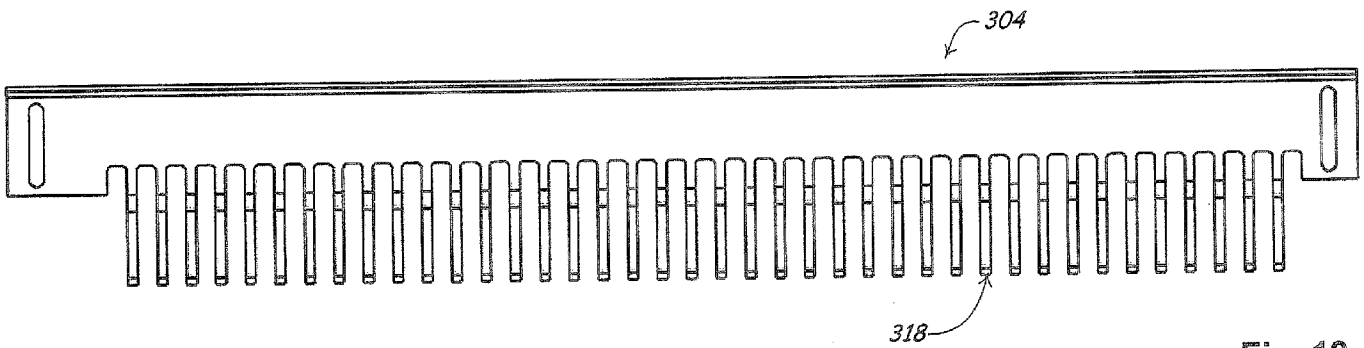
FIG. 12 is a front plan view of the lower finger bar.
Figure 13:
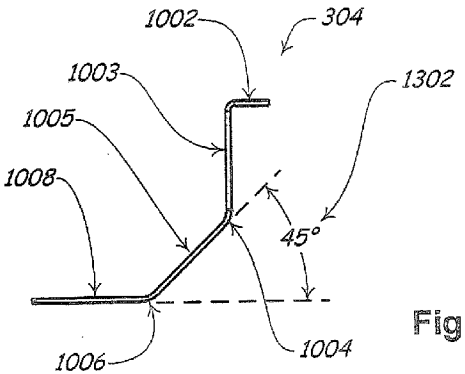
FIG. 13 is a side view of the lower finger bar.
Figure 14:
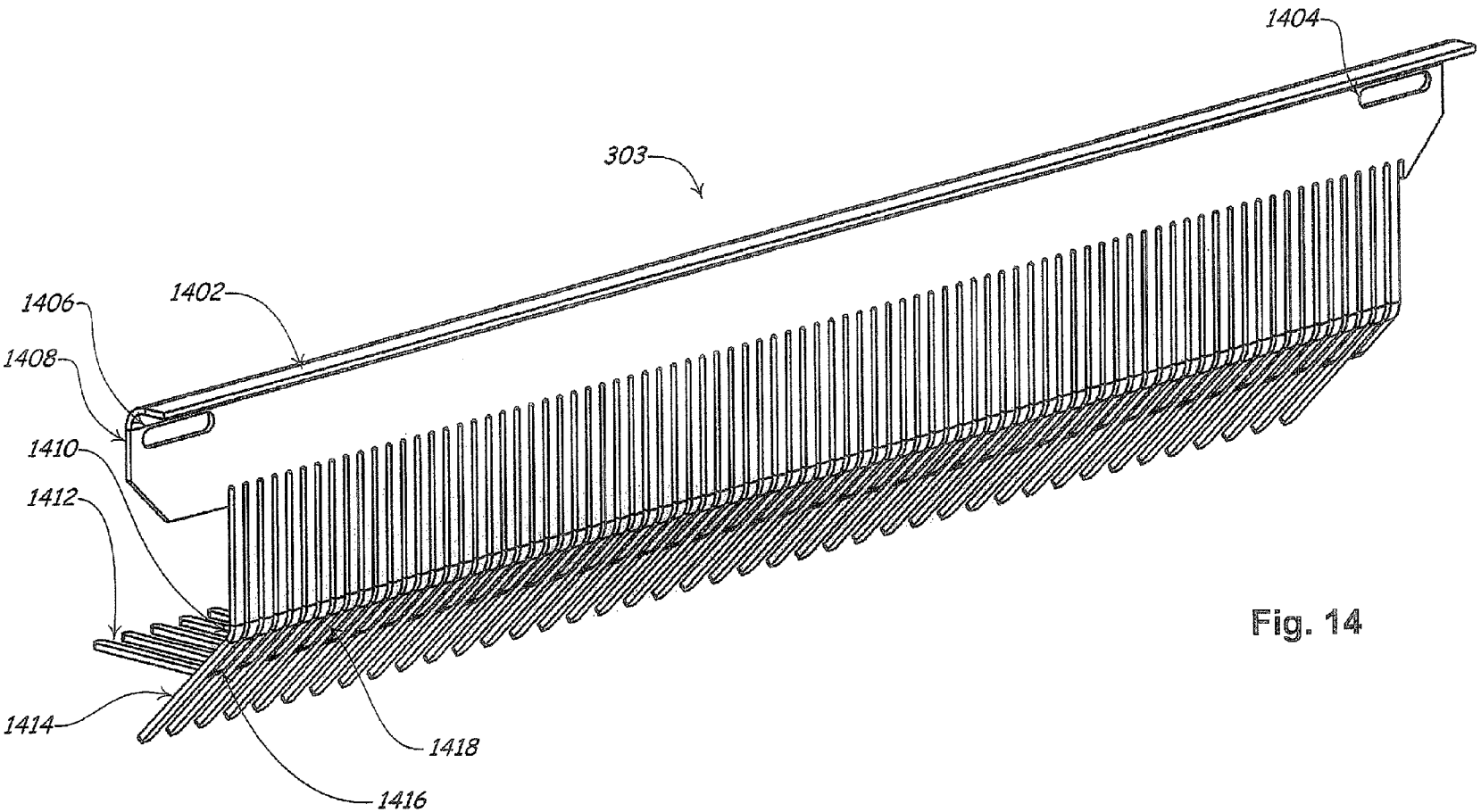
FIG. 14 is a perspective view of the optional two stage single finger bar.
Figure 15:
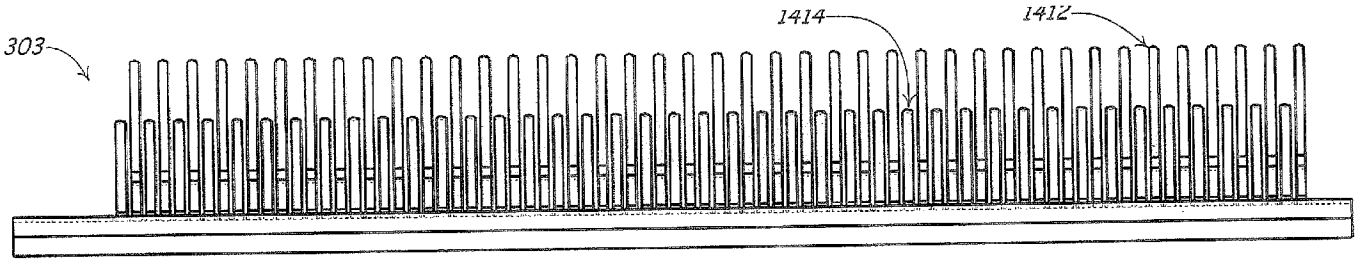
FIG. 15 is a top plan view of the optional two stage single finger bar.
Figure 16:
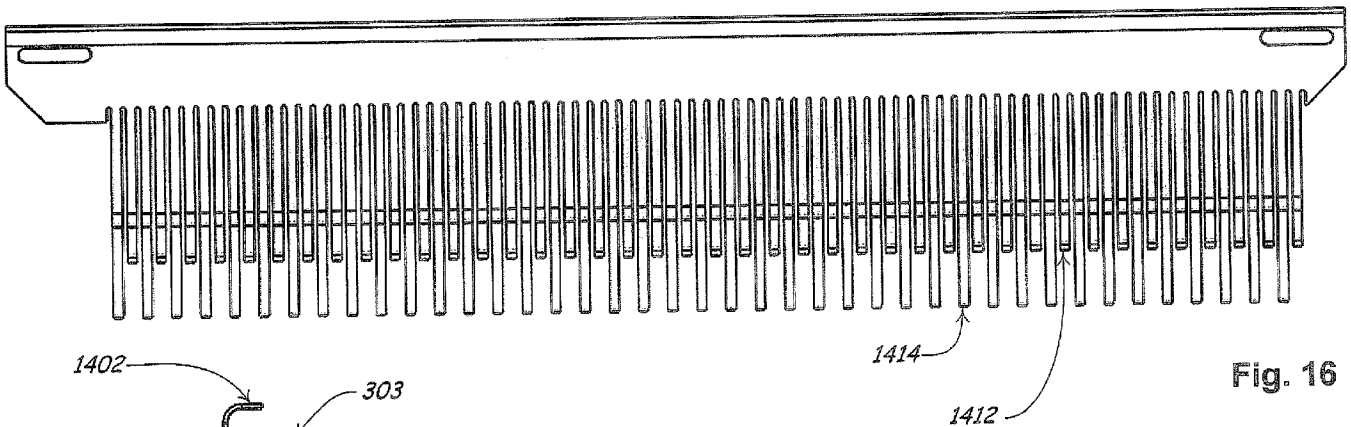
FIG. 16 is a front plan view of the optional two stage single finger bar.
Figure 17:
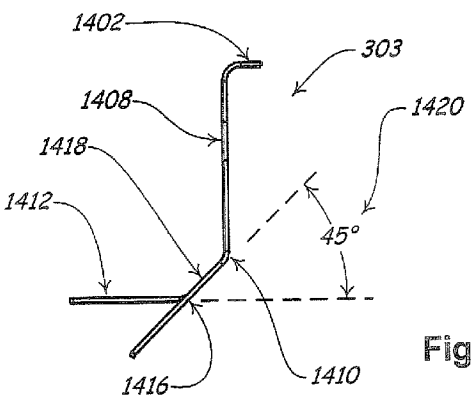
FIG. 17 is a side plan view of the optional two stage single finger bar.

Referring to FIG. 10, a perspective view of the lower finger bar comb 304 is shown. The lower finger bar comb is shown with mounting slots 1009 and 1010 that are elongated to allow for adjustment of the finger bar comb. The lower finger bar comb is shown configured with teeth or fingers having multiple bends 1004 and 1006 and straight flat extensions 1005 and 1008. The side view of the comb as shown in FIG. 13 reveals the angular bends in the fingers of the lower finger bar comb 304. One embodiment as shown provides a flat portion 1003, which extends to the fingers at which extend and bend approximately 45 degree bend 1302 relative to the line of the flat surface 1003 extending to extension 1005 which then extends to a bend to at about approximately 90 degrees with respect to the line of 1003. Referring to FIGS. 11 and 12, the fingers 318 of the lower finger bar comb are shown which can extend into the spaces between the blades of the cutter. Where the fingers address the cutter is adjustable using the elongated slots 1009.

The process begins by conveying a whole muscle product toward the cutter assembly 110 with the in-feed conveyor 106. the whole muscle product is conveyed along a path to engage the cutter assembly at the interface 326 of the pinch roller 306 and the push roller 307. The pinch roller 306 having a ribbed roll surface 312 and the push roller 307 having a textured roll surface 314 comprising teeth intermeshed in relationship to the rib surface of the pinch roller grasps the whole muscle product and pushes the product through the cutter assembly. The whole muscle product is fed along a line of entry 201 or line of engagement into the engagement interface 326 of the pinch roller and the push roller. The whole muscle product is advanced to engage the cutter 308 or a rotatable cutting roller having a plurality of circular spaced apart blades or fins along the length of the cutting roller. The circular blades 310 are spaced apart along the length of the cutting roller forming cutting fins along the length of the roller. The whole muscle product is cut into product slices having a width defined by the space between adjacent cutting blades.

With the two finger bar embodiment, the fingers or teeth of the lower finger bar 304 will engage every other slice and divert every other slice to the lower takeaway conveyor 108. The slices that are diverted to the lower conveyor are then conveyed away from the cutter assembly for further processing. The remaining slices are then diverted by the fingers or teeth of the upper finger bar 302 onto the upper takeaway conveyor 109. The takeaway conveyor 109 will then convey the sliced product away from the cutter assembly for further processing. The process is such that immediately adjacent product slices are diverted to separate takeaway conveyors such that when the product slices are diverted to the takeaway conveyors there is adequate spacing between the product slices such that they do not adhere to the adjacent slice. This spacing facilitates further down line processing whereby the operator does not have to manually separate edges and slices.

With regard to the single comb embodiment, the single comb is designed with two separate sets of fingers or teeth that are bent or angled differently such that one set of teeth engages the meat slices prior to the second set of teeth. The single comb configuration performs the same task as the two comb configuration in that the first set of teeth diverts every other product slice to the lower takeaway conveyor and the second set of teeth diverts the remaining product slices to the upper takeaway conveyor.

In either the single comb or the two comb embodiments, the teeth of the comb extend into the space between adjacent cutting blades of the cutting roller. By extending into these spaces the fingers will engage the sliced meat product captured between the cutting blades thereby diverting the product slices. The angle 202 of the cutter assembly off-vertical and the line of engagement 201 of the whole muscle product facilitates diverting the product slices to an upper and lower conveyor. Addressing the cutter at two separate points of engagement diverts the cut product to the conveyors.

Figure 4A:
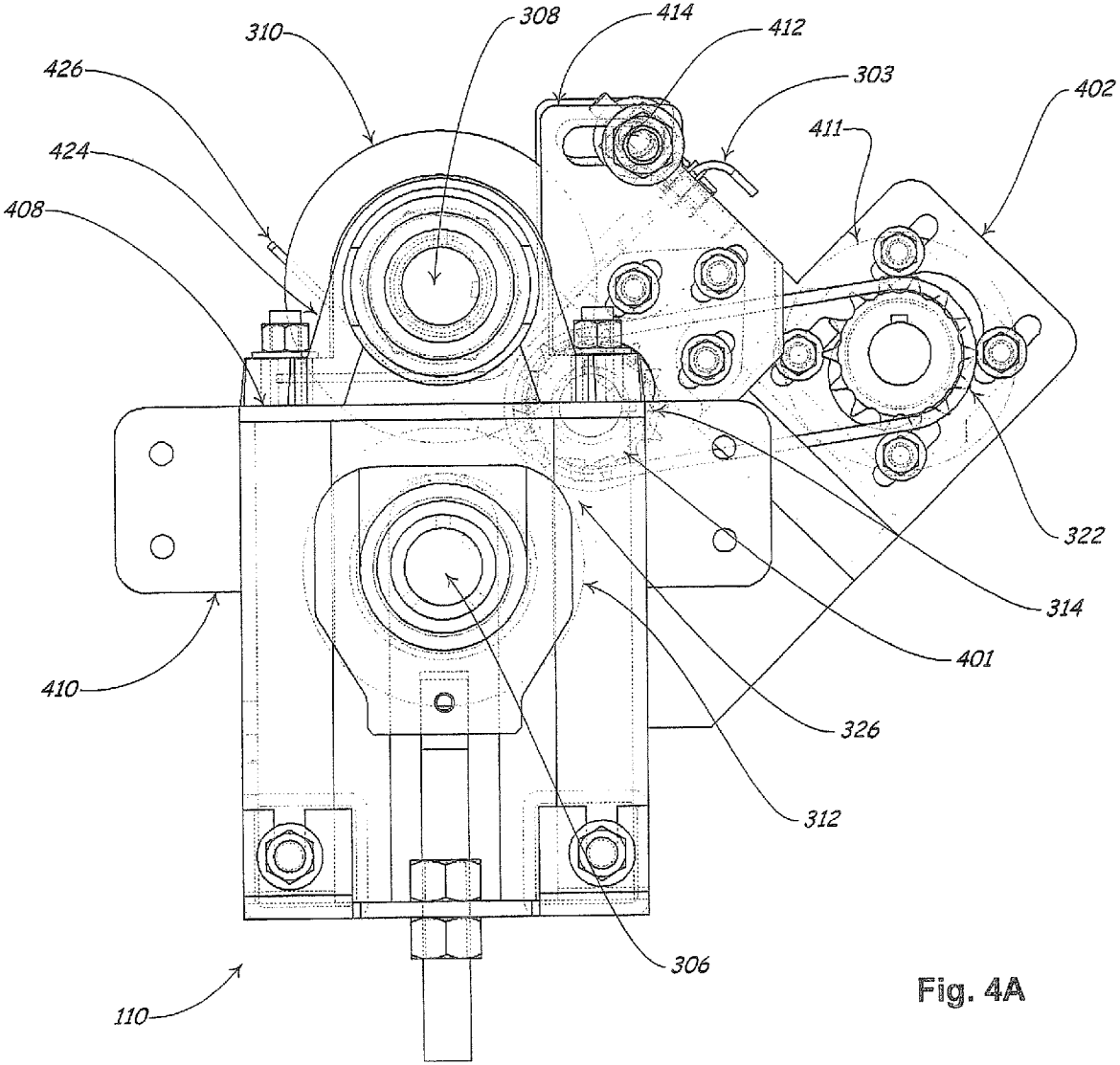
FIG. 4A is a side with single finger bar.

The approach angle or slope of the in-feed conveyor can also be adjusted to optimize the path of engagement for engaging the cutter assembly. The angle 202 of the cutter assembly can also be adjusted thereby adjusting the line of engagement 201 to optimize feeding a whole muscle product into the cutter. The relative height of the cutter assembly and the takeaway conveyors can also be adjusted in order to optimize the diverting or deflecting of the product slices onto the upper and lower conveyors. The two finger bar system shown in FIG. 2 shows the upper and lower conveyor configuration. The takeaway conveyors extend to the cutter assembly to receive the diverted or deflected product slices. FIG. 4 reveals the extension of the fingers by the lower finger bar 304 extending between the blades of the cutter 308. The fingers are shown as shadow lines in FIG. 4 that extend to the detecting point 420 as shown. Similarly, the fingers of the finger bar 302 are also shown extending between the cutter blade to a deflection point 422. It is at these deflection points 420 and 422 that the product slashes are diverted to the lower and upper takeaway conveyors, respectively. FIG. 4A illustrates the single finger bar configuration having a first and second set of fingers extending between the cutter blades at two deflection points 424 and 426.

Figure 4B:
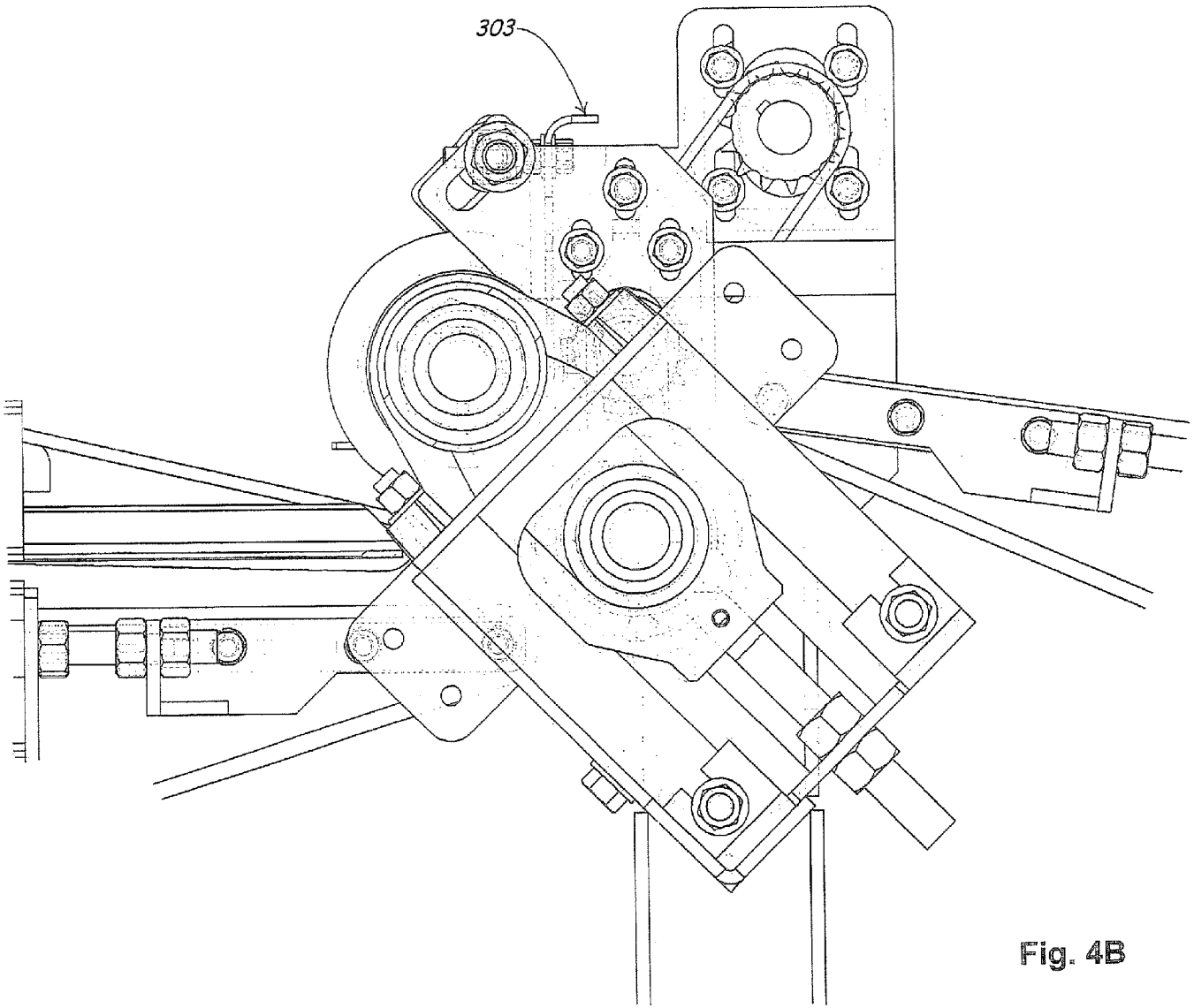
FIG. 4B is a side with single finger bar mounted at an angle off vertical.

The deflection point 424 is the location where the first set of fingers addresses the cutter and deflects product slices onto the lower takeaway conveyor. The second deflection point 426 is where the second set of fingers addresses the cutter and deflects the remaining product slices onto the upper takeaway conveyor. FIG. 4B provides a closer view of the cutter assembly in relationship to the upper and lower takeaway conveyors and the in-feed conveyor.

The shadow lines of the push roller and the pinch roller shown in FIG. 4B illustrates the product path as it travels through the cutter blade. The product is conveyed along the in-feed conveyor to engage the teeth of the push roller which in turn pushes the meat product into an engagement between the push roller and the pinch roller thereby advancing the whole muscle product into an engagement between the pinch roller and the cutter. The pinch roller pinches the whole muscle product against the blades of the cutter to thereby effect slicing the whole muscle product into thin product slices captured between the blades of the cutter. As the product slices are severed and captured between the blades of the cutter, the product slices are driven into engagement with the fingers of the finger bar which extend into the same spaces thereby deflecting the product slices and cleaning them out of the spaces between the cutter blades and diverting onto the takeaway conveyors.

The rotation of the cutter and the rollers are affected a motor 114 and belt system. The motor is sufficient to drive the whole muscle product through the cutter to be deflected onto the takeaway conveyors.

FIGS. 6 through 13 reveal the two finger bars of the two finger bar embodiment. FIGS. 14 through 17 reveal the single finger bar embodiment. The single finger bar 303 is shown in FIG. 3A having its two set of fingers extending between the blades of the cutter.

The single finger bar 303 has elongated mounting slots 1404 and 1406 for lateral adjustment. The finger bar length 1402 transitions to the main panel of finger bar 1408 having the first set and the second set of fingers extending therefrom 1414 and 1412 respectively. The fingers extend from the main portion of the finger bar to a 45 degree bend 1410 and continues along a straight line 1418. The first set of finger bar fingers 1414 or teeth continue along that line however, the second set of finger bars 1412 makes an additional bend at 1416 and then extends along a straight line.

The positions of the in-feed conveyor, the cutter assembly, and the take-away conveyor can be adjusted to optimize the in feed of product along the line of entry and the diverting of the product onto take away conveyors. As discussed above, the whole muscle product to be sliced can be flattened to the appropriated thickness to allow travel between the pinch roller and the cutter. The product can be placed on the in-feed conveyor for conveying the flattened product along the line of entry for engagement with the cutter.

The push roller can engage the product and push it through the interface between the pinch roller and the cutting roller. The pinch roller engages the product and pinches the product against the cutting roller and pulls the product through the pinching engagement. As the product travels through the cutting roller the product is sliced into thin slices. The upper and lower finger bars having fingers extending between the blades of the cutter can then divert separate alternate first and second sets of sliced product onto first and second take-away conveyors. The take away conveyors can take away the sliced and separated product slices to the next stage of processing. The same can be accomplished with a single finger bar having fingers or teeth extending between each of the blades where adjacent fingers alternate with different bends thereby addressing the cutter at different points.

The various cutter and separator apparatus and method examples shown above illustrate a novel method for separating the slices as the slices travel through the cutter. A user of the present invention may choose any of the above cutter and separator embodiments, or an equivalent thereof, depending upon the desired application. In this regard, it is recognized that various forms of the subject slicer and separator apparatus and method could be utilized without departing from the spirit and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the sprit and scope of the present invention.

Other aspects, objects and advantages of the present invention can be obtained from a study of the drawings, the disclosure and the appended claims.

What is claimed is:

1. A whole muscle slicer and separator assembly comprising:

a frame for supporting a cutter assembly;

a cutter assembly mounted on said frame and including a rotatable cutting roller having multiple proximately spaced apart radially extending circular cutting blades along the length of the cutting roller and a rotatable pinch roller having multiple proximately spaced apart radially extending circular ribs along the length of the pinch roller, where the pinch roller is oriented such that each of the ribs extend into spaces between the circular blades for pulling a whole muscle product into engagement with the cutting roller and where the cylindrical axis of the cutting roller and the cylindrical axis of the pinch roller lie in a first common plane;

said cutter assembly is mounted on said frame such that said first common plane is not horizontal or vertical for optimally receiving a whole muscle product; and a finger bar comb mounted on said frame and having a first set of spaced apart finger members having a first bend that addresses the cutting roller at a first point by extending into a first set of alternate spaces between the cutting blades for diverting a first set of alternate product slices and said finger bar comb further having a second set of spaced apart finger members that addresses the cutting roller at a second point by having a second bend different from the first bend and extending into a remaining second set of alternate spaces between the cutting blades for diverting a remaining second set of alternate product slices, and a first take-away conveyor positioned proximate the first point where the first set of finger members address the cutting roller for receiving and conveying away the first set of alternate product slices.

2. The slicer and separator assembly as recited in claim 1, further comprising:

a second take-away conveyor positioned proximate the second point where the second set of finger members address the cutting roller for receiving and conveying away the remaining second set of alternate product slices.

3. The slicer and separator assembly as recited in claim 2, where said second set of fingers have angular bends toward the cutting roller for properly addressing the cutting roller at the second point and to facilitate diverting the product slices.

4. The slicer and separator assembly as recited in claim 3, further comprising:

a push roller having a cylindrical axis the lies in a second common plane with the cylindrical axis of the pinch roller and where the pinch roller has a textured surface comprising proximately spaced apart circumferential radially protruding ribs and where the push roller has a textured surface comprising radially protruding teeth members and where the blades of the cutting roller, the ribs of the pinch roller and the teeth of the push roller are disposed in a intermeshed relationship for driving the product through the cutting roller and thereby creating an entry interface between the pinch roller and the push roller.

5. The slicer and separator assembly as recited in claim 4, further comprising:

an infeed conveyor having an exit end dispose proximate the entry interface between the pinch roller and the push roller and disposed to feed the product into the entry interface and along the line of entry.

6. The slicer and separator assembly as recited in claim 5, where the cutting roller and the pinch roller are oriented such that the first common plane is oriented proximate 45 degrees off vertical, and where the first and second takeaway conveyors are one above the other and where the positions of the first and second take away conveyors, the cutter assembly and the infeed conveyor are adjustable.

7. The slicer and separator assembly as recited in claim 6, where the first common plane is oriented between 25 and 65 degrees off vertical.

8. A whole muscle slicer and separator assembly comprising:

a frame for supporting a cutter assembly;

a cutter assembly mounted on said frame and including a rotatable cutting roller having spaced apart circular cutting blades along the length of the cutting roller and a rotatable pinch roller, where the pinch roller is oriented proximate the cutting roller and such that the cylindrical axis of the cutting roller and the cylindrical axis of the pinch roller lie in a first common plane for pulling a product along a line of entry into engagement with the cutting roller;

said cutter assembly is mounted on said frame such that said first common plane is not horizontal or vertical for optimally receiving the product;

an in-feed conveyor oriented to feed product into engagement with the pinch roller and cutting roller along the line of entry; and a finger bar comb mounted on said frame and having a first set of spaced apart finger members with a first bend that addresses the cutting roller at a first point by extending into a first set of alternate spaces between the cutting blades for diverting a first set of alternate product slices and said finger bar comb further having a second set of spaced apart finger members with a second bend different from the first bend that addresses the cutting roller at a second point by extending into a remaining second set of alternate spaces between the cutting blades for diverting a remaining second set of alternate product slices, and a first take-away conveyor positioned proximate the first point where the first set of finger members address the cutting roller for receiving and conveying away the first set of alternate product slices.

9. The slicer and separator assembly as recited in claim 8, further comprising:

a second take-away conveyor positioned proximate the second point where the second set of finger members address the cutting roller for receiving and conveying away the remaining second set of alternate product slices.

10. The slicer and separator assembly as recited in claim 9, further comprising:

a push roller having a cylindrical axis the lies in a second common plane with the cylindrical axis of the pinch roller and where the pinch roller has a textured surface comprising proximately spaced apart circumferential radially protruding ribs and where the push roller has a textured surface comprising radially protruding teeth members and where the blades of the cutting roller, the ribs of the pinch roller and the teeth of the push roller are disposed in a dove tail relationship for driving the product through the cutting roller and thereby creating an entry interface between the pinch roller and the push roller.

11. The slicer and separator assembly as recited in claim 10, further comprising:

an infeed conveyor having an exit end dispose proximate the entry interface between the pinch roller and the push roller and disposed to feed the product into the entry interface and along the line of entry.

12. The slicer and separator assembly as recited in claim 11, where the cutting roller and the pinch roller are oriented such that the first common plane is oriented proximate 45 degrees off vertical, and where the first and second takeaway conveyors are one above the other and where the positions of the first and second take away conveyors, the cutter assembly and the infeed conveyor are adjustable.

13. The slicer and separator assembly as recited in claim 12, where the first common plane is oriented between 25 and 65 degrees off vertical.

14. A whole muscle slicer and separator assembly comprising:

a frame for supporting a cutter assembly;

a cutter assembly mounted on said frame and including a rotatable cutting roller having multiple proximately spaced apart radially extending circular cutting blades along the length of the cutting roller and a rotatable pinch roller having multiple proximately spaced apart radially extending circular ribs along the length of the pinch roller, where the pinch roller is oriented such that each of the ribs extend into spaces between the circular blades for pulling a whole muscle product along a line of entry into engagement with the cutting roller and where the cylindrical axis of the cutting roller and the cylindrical axis of the pinch roller lie in a common plane;

said cutter assembly is mounted on said frame such that said common plane is not horizontal or vertical for optimally receiving a whole muscle product;

said cutter assembly further including a single finger bar comb having a first set of fingers with a first bend extending into every other space between the cutting blades for diverting and separating a first set of sliced product at the cutter assembly and a second set of fingers with a second bend different from the first bend and extending into the remaining alternate spaces between the cutting blades for diverting and separating a second set of sliced product at the cutter assembly;

an in-feed conveyor oriented to feed product into engagement with the pinch roller and cutting roller along the line of entry;

a first take-away conveyor oriented for receiving and conveying away the first set of sliced product; and a second take-away conveyor oriented for receiving and conveying away the second set of sliced product.

* * * * *